US005595120A

United States Patent [19]

Métrope

[11] Patent Number: 5,595,120

[45] Date of Patent: Jan. 21, 1997

[54] DEVICE FOR FEEDING PRINTING FORMS TO AND CHANGING THEM ON A PRINTING FORM CYLINDER

[75] Inventor: Jacques Métrope, Laigneville, France

[73] Assignee: Heidelberger Druckmaschinen AG, Heidelberg, Germany

[21] Appl. No.: 627,776

[22] Filed: Apr. 1, 1996

[30] Foreign Application Priority Data

Mar. 31, 1995 [FR] France ..... 95/03829

[51] Int. Cl.[6] ..... B41F 1/28

[52] U.S. Cl. ..... 101/477; 101/415.1

[58] Field of Search ..... 101/477, 415.1, 101/378, 132

[56] References Cited

U.S. PATENT DOCUMENTS

| | | | |
|---|---|---|---|
| 5,127,328 | 7/1992 | Weiland | 101/415.1 |
| 5,289,775 | 3/1994 | Spiegel et al. . | |
| 5,293,820 | 3/1994 | Maejima et al. . | |
| 5,331,892 | 7/1994 | Seib et al. | 101/477 |
| 5,394,614 | 3/1995 | Lindner et al. | 101/415.1 |
| 5,443,006 | 8/1995 | Beisel et al. | 101/477 |
| 5,479,858 | 1/1996 | Beisel et al. . | |
| 5,483,892 | 1/1996 | Stiel | 101/477 |
| 5,511,478 | 4/1996 | Lindner et al. | 101/477 |
| 5,540,151 | 7/1996 | Ruckmann et al. | 101/477 |

FOREIGN PATENT DOCUMENTS

| | | |
|---|---|---|
| 0431364 | 6/1991 | European Pat. Off. . |
| 0519583 | 12/1992 | European Pat. Off. . |
| 0520594 | 12/1992 | European Pat. Off. . |
| 0530577 | 3/1993 | European Pat. Off. . |
| 0567754 | 11/1993 | European Pat. Off. . |
| 0570702 | 11/1993 | European Pat. Off. . |
| 0570702A1 | 11/1993 | European Pat. Off. . |
| 94/06632 | 3/1994 | WIPO . |

*Primary Examiner*—Eugene H. Eickholt
*Attorney, Agent, or Firm*—Herbert L. Lerner; Laurence A. Greenberg

[57] ABSTRACT

Device for changing printing forms on a printing-press form cylinder having a gap formed therein containing a holding device associated with a printing start, the holding device having a gripping region openable so as to form a gap extending over a printing-form format width for taking up a leading edge of a printing form therein, includes a swivelable holding element for selectively removing a first printing form from the form cylinder and applying a second printing form onto the form cylinder.

15 Claims, 7 Drawing Sheets

110
117
108
111
114
109
105
101
113
125
104
106
107
116
115
103
119
118
120
112
124
122
123
121
102

110
117
108
120
111
114
113
109
105
101
106
104
107
116
115
103
119
118
120
112
124
121
122
123
102
121

DEVICE FOR FEEDING PRINTING FORMS TO AND CHANGING THEM ON A PRINTING FORM CYLINDER

BACKGROUND OF THE INVENTION

Field of the Invention

The invention relates to a device for feeding printing forms to and changing them on a printing-form cylinder of a printing press, the printing-form cylinder being formed with a cylinder groove wherein a holding device associated with the start of printing is disposed, the holding device having an openable gripping zone formed as a gap extending over a format width of a respective printing form for receiving therein a leading edge of a printing form such as a printing plate.

The published European Patent Document EP 0 431 364 A2 describes a manipulation device for loading plate cylinders on rotary printing presses. A vertically displaceable and swivelably mounted robot arm, which is subdivided by at least one articulation into a plurality of parts, is provided on a guide and has an operating or manipulating head on a part thereof which is most distant from the guide. By means of this device, it is possible to remove printing plates located in elevated printing units of rotary printing presses of the turret or tower construction type.

The published German Patent Document EP 0 567 754 A1 discloses a device for feeding a printing plate onto a plate cylinder of a printing press. Included is an element for supporting and guiding a plate formed of at least one readily rotatable roller which, when in a plate changing position, has a side thereof which faces towards the printing unit disposed substantially on a straight line extending parallel to clamping surfaces of the device for taking up the leading edge of the plate which passes between the clamping surfaces and emerges inclined upwardly out of the printing unit. A suction cup may furthermore be arranged on this line as another element for holding and guiding the printing plate, a borehole via which the suction cup may be vented being provided in a rear region of this plate.

The published German Patent Document EP 0 570 702 A1 is concerned with a device for feeding printing plates onto a plate cylinder of printing presses, in particular, sheet-fed offset printing presses. On the plate cylinder which is movable into a given angular position, an insertion bar extending over the format width of the plate cylinder is adjustable at the outer peripheral surface of the plate cylinder in a print start region, so that the leading edge of the printing plate can be introduced by the insertion surface formed by this insertion bar directly into the gripping region of a print-start clamping bar. The outer peripheral surface of the plate cylinder thus forms with the insertion bar a funnel-shaped region for the leading edge of the printing plate. All the components respectively guiding and supporting the printing plate during the insertion thereof are arranged in front of the plate cylinder, which limits the accessibility thereof.

SUMMARY OF THE INVENTION

It is accordingly an object of the invention to provide a device for feeding printing forms to and changing them on a plate cylinder which is improved over prior-art devices of this general type in that, on the one hand, manipulation of the printing forms on the device itself is simplified and, on the other hand, accessibility to the printing unit is maintained.

With the foregoing and other objects in view, there is provided, in accordance with the invention, a device for changing printing forms on a printing-press form cylinder having a gap formed therein containing a holding device associated with a printing start, the holding device having a gripping region openable so as to form a gap extending over a printing-form format width for taking-up a leading edge of a printing form therein, comprising a swivelable holding element for selectively removing a first printing form from the form cylinder and applying a second printing form onto the form cylinder.

In accordance with another feature of the invention, the swivelable holding element includes an extension extensible to at least proximate to the surface of the form cylinder.

In accordance with another feature of the invention, the printing-form changing device includes a swivel pin about which the holding element is swivelable.

In accordance with a further feature of the invention, the holding element has at least two sides, and take-up elements are provided which are disposed on the two sides of the holding element.

In accordance with an added feature of the invention, the take-up elements are formed as suction cups subjectible to negative pressure.

In accordance with an additional feature of the invention, the printing-form changing device includes a magazine operatively associated with the swivelable holding element.

In accordance with yet another feature of the invention, the magazine is subdivided into a plurality of chambers.

In accordance with yet a further feature of the invention, the magazine is formed with lateral openings.

In accordance with yet an added feature of the invention, the magazine is formed with a front chamber and a rear chamber relative to the form cylinder.

In accordance with yet an additional feature of the invention, the magazine is formed with a subdividing partition between the chambers.

In accordance with still another feature of the invention, the partition is formed with a curved region.

In accordance with still a further feature of the invention, the front and rear chambers are formed with respective bottom surfaces, the bottom surface of the rear chamber being located at a higher elevation than that of the bottom surface of the front chamber.

In accordance with still an added feature of the invention, the printing-form changing device includes a magazine for printing forms, the magazine being formed with a guide, and the extension of the swivelable holding element in a position thereof close to the form cylinder being disposed above the guide of the magazine.

In accordance with still an additional feature of the invention, the extension of the swivelable holding element serves as a stop for the first printing form to be removed from the form cylinder.

In accordance with a concomitant feature of the invention, the swivelable holding element is swivelable with the second printing form which is being applied to the form cylinder so that an edge of the second printing form is placed against the surface of the form cylinder.

Because only a single swivelable holding element is provided both for removing the printing form or plate located on the printing-form or plate cylinder and for feeding a new printing form or plate to be installed, the space located in front of the printing-unit cylinders is accessible during the operation of the printing press, i.e., when no changing or replacement of printing forms or plates occurs, so that the pressman is not subjected to any hindrances whatsoever thereby. The printing forms or plates can be removed or withdrawn from the magazine through lateral openings as well as from above, the magazine making allowance for these ergonomic facilities to a very great extent.

As mentioned hereinbefore, according to further advantageous features of the invention, the swivelable holding element has an extension which, when disposed in a horizontal position, extends closely to the surface of the printing-form or plate cylinder. The swivelable holding element which swivels about a pin is equipped with upper and lower take-up or retention elements which, in the exemplary embodiment represented, are formed as suckers or suction cups subjectible to vacuum or negative pressure. The swivelable holding element is arranged above a magazine which is subdivided by a partition. The partition, which subdivides the magazine into a front chamber and a rear chamber, is formed with a sharp curvature in an upper part thereof, which facilitates the positioning of a new printing form or plate on the surface of the printing-form or plate cylinder. The rear chamber is arranged at a slightly higher elevation than that of the front chamber of the magazine, on the one hand, in order to facilitate gripping of the new printing form or plate by the swivelable holding element and, on the other hand, to simplify manipulation of the printing forms or plates by the pressman. The extension of the swivelable holding element, when occupying the horizontal position thereof, forms with the guide located on the magazine an insertion gap into which the trailing or rear part of the printing form or plate removed from the cylinder is introduced and is temporarily immobilized by the take-up or retention members provided on the then lower side of the swivelable holding element.

Other features which are considered as characteristic for the invention are set forth in the appended claims.

Although the invention is illustrated and described herein as embodied in a device for feeding printing forms to and changing them on a printing-form cylinder, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings, in which:

DESCRIPTION OF THE PREFERRED EMBODIMENTS

Figure 1:
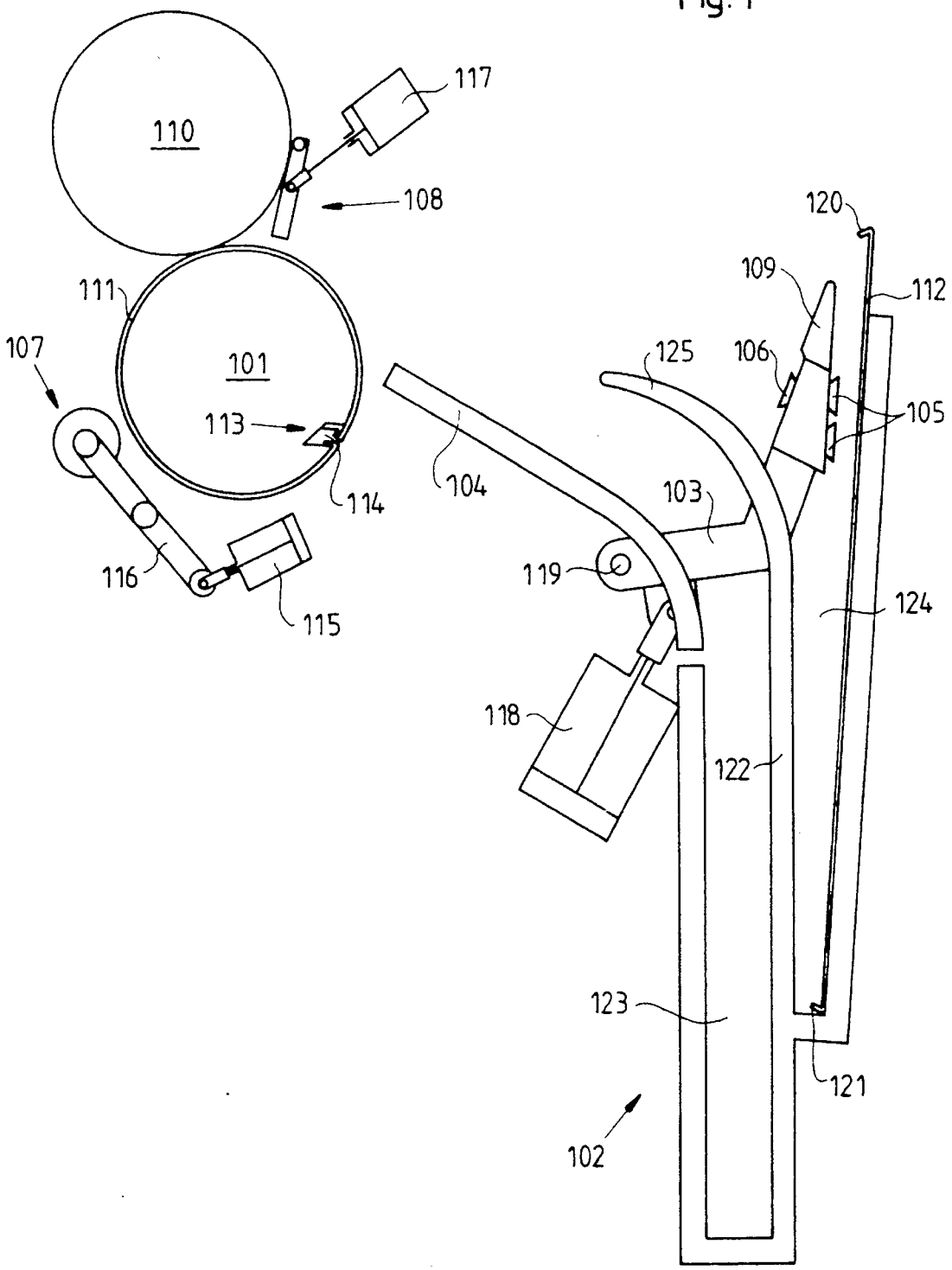
FIG. 1 is a diagrammatic side elevational view of a printing-form feeding and changing or replacement device according to the invention showing a first printing form or plate on a printing-form or plate cylinder, and a second printing form or plate provided in a chamber of a magazine for placement on the printing-form or plate cylinder.

Referring now to the drawings and, first, particularly to FIG. 1 thereof, there is shown therein, in a side elevational view, a printing-form or printing plate feeding and changing or replacement device wherein a printing form or plate provided in a chamber of a magazine is to be fed onto a printing-form or plate cylinder.

A printing unit located under a web of printing material includes a transfer cylinder 110 as well as a printing-form or plate cylinder 101 on which a first printing form such as a printing plate 111 is disposed. A protection device 108 actuatable by an adjusting or positioning module 117 is associated with the cylinder pair 101, 110. A pressure element 107 associated with the printing-form cylinder 101 is engageable with and disengageable from the surface of the printing-form cylinder 101 by means of a lever 116 displaced by an adjusting or positioning module 115.

The plate cylinder 101 receives the bent leading and trailing ends of the printing form or printing plate 111 in a channel or gap 114 wherein a holding or fastening device 113 is disposed. The latter is represented only diagrammatically in FIG. 1, and the specific construction thereof forms no part of the invention herein.

A printing-form or printing-plate magazine 102 as well as a swivelable holding element 103 are associated with the cylinder pair 101, 110. The swivelable holding element 103 has an extension 109 which, as shown in FIG. 2, in a condition wherein it is positioned engaged with or close to the surface of the printing-form or plate cylinder 101, is located above a lower guide 104 of the magazine 102 and forms at this position a gap for the insertion of a printing form or plate 111 which is to be removed from the printing-form or plate cylinder 101.

The swivelable holding element 103 is movable about a swivel pin 119 by means of an adjusting or positioning module 118 and is equipped with upper and lower take-up elements 105 and 106, respectively. The positioning module 118 may operate pneumatically or hydraulically; just as well, an electromotorized positioning module is also conceivable. In the exemplary embodiment which is illustrated, the take-up elements 105 and 106 are formed as suction cups subjected to vacuum or negative pressure. Furthermore, magnetic devices or take-up elements fixing the printing plates 111 and 112 by a form-locking connection are also conceivable. In this regard, it is noted that a form-locking connection connects two elements together due to the shape of the elements themselves, as opposed to a form-locking connection wherein the elements are locked together by force external to the elements.

The printing-form magazine 102 is formed with two chambers 123 and 124 which are separated by a partition 122, the bottom of the rear chamber 124 being disposed slightly higher than that of the front chamber 123. Thus, the printing forms or printing plates 112, respectively, which are to be fed onto the cylinder, are positioned at such a height in the magazine 102 that they are located opposite the take-up elements 105 of the swivelable holding element 103 in a vertical position thereof, and making it possible for the second printing form 112 to be gripped easily thereby. The partition 122 is formed with a sharp curvature 125 in an upper region thereof which, on the one hand, defines an inlet gap for receiving therein a printing form or plate 111 to be removed from the form cylinder 101 and, on the other hand, aids in the positioning at the surface of the cylinder 101 of the printing form or plate 112 which is to be fed thereon.

Figure 2:
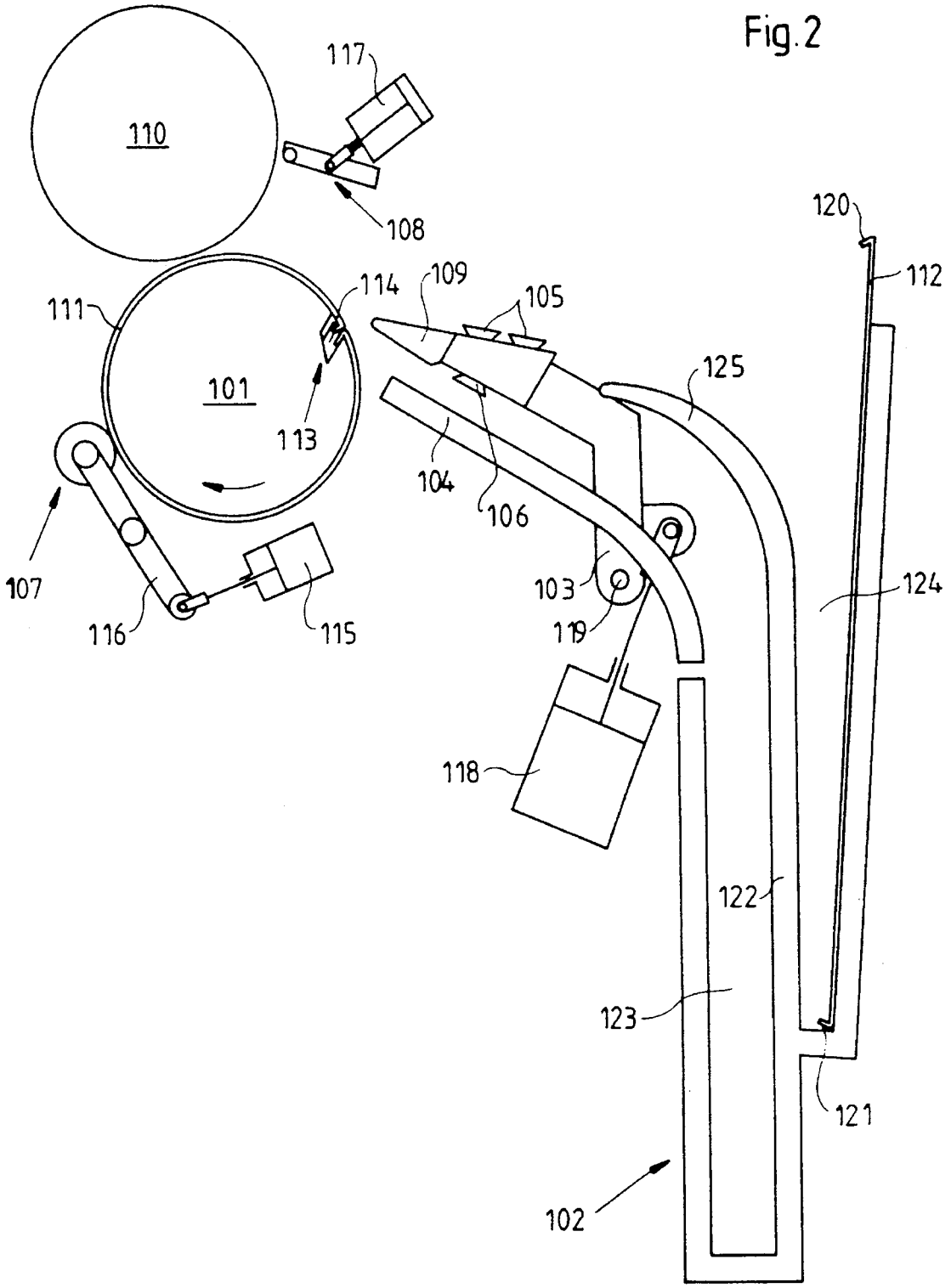
FIG. 2 is a view like that of FIG. 1 in another operating phase of the device according to the invention, wherein a swivelable holding element has been moved into an operating position.

FIG. 2 shows the holding element 103 swiveled into the operating position thereof.

The two cylinders 101 and 110 rotate slowly in reverse direction, the protection device 108 having been swung away out of nip formed between the outer cylindrical surfaces of the cylinders 101 and 110. The swivelable holding element 103 swings into a position wherein the extension 109 thereof is disposed parallel to the guide 104 and defines therewith an insertion gap. The pressure element 107 is then positioned at the surface of the printing form or plate 111 which is to be removed.

Figure 3:
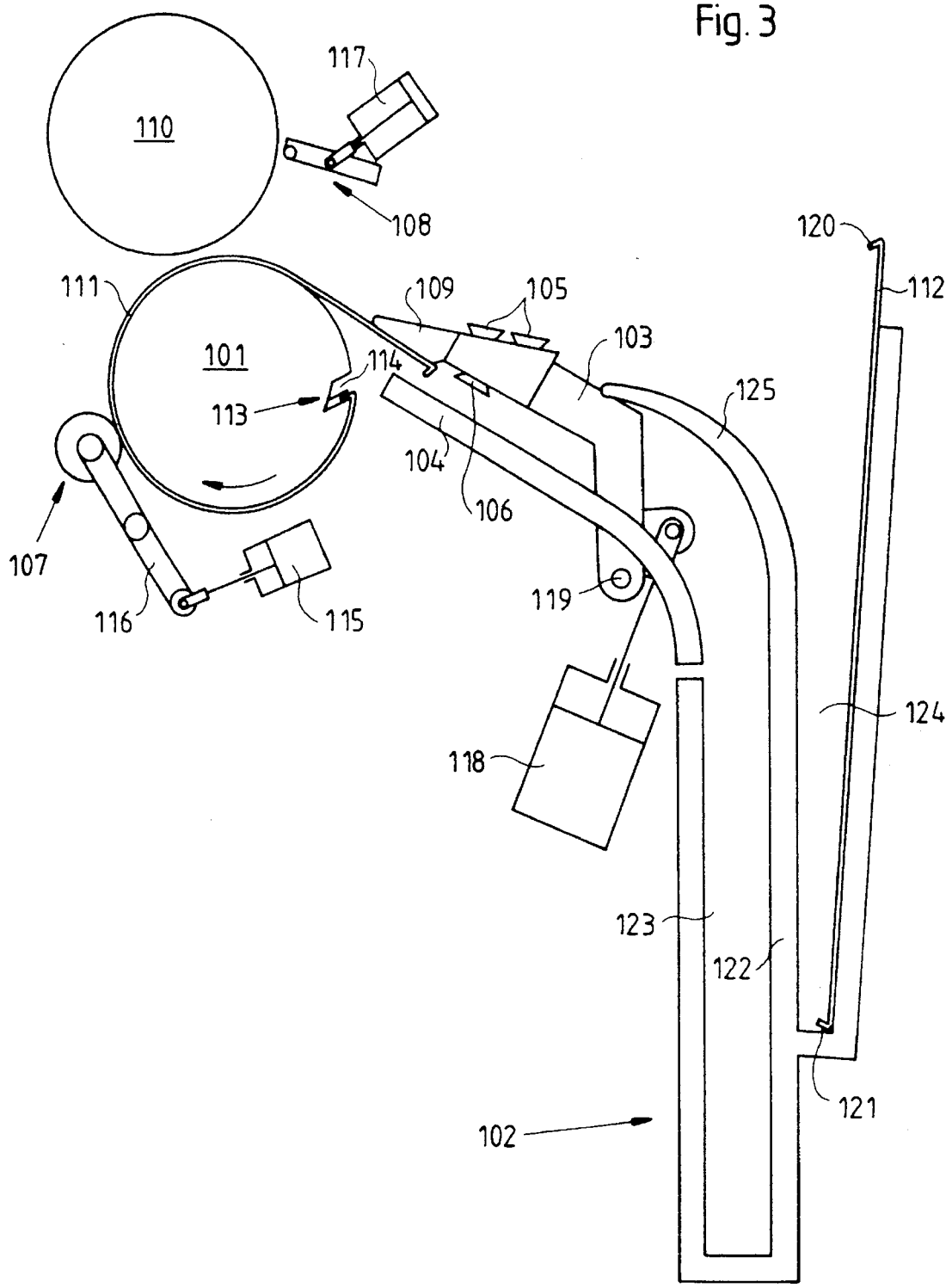
FIG. 3 is also a view like that of FIGS. 1 and 2 in a further operating phase of the device, wherein the first printing form is being removed or withdrawn from the printing-form or plate cylinder and introduced into a gap defined by the swivelable holding element and a guide.

FIG. 3 represents the release of the trailing end of the printing form or plate 111.

The holding device 113 located in the gap or channel 114 formed in the plate cylinder 101 releases the trailing end of the plate 111 which is to be removed from the cylinder 101. Due to the intrinsic or inherent elasticity of the printing form or plate 111, the trailing end thereof swings out of the gap or channel 114 and impacts with the extension 109 of the swivelable holding element 103. The slow reverse movement of the printing-form or plate cylinder 101 causes the rearward or trailing part of the printing form or plate 111, which is to be removed from the cylinder 101, to penetrate into the insertion gap defined by the extension 109 and the guide 104 and to run into the front chamber 123. Due to the extension 109, the curvature of the printing form or plate 111 resulting from the intrinsic or inherent stiffness thereof, is such that this printing form or plate 111 does not come into contact with the surface of the transfer cylinder 110 during the removal of the printing form or plate 111 from the cylinder 101.

Figure 4:
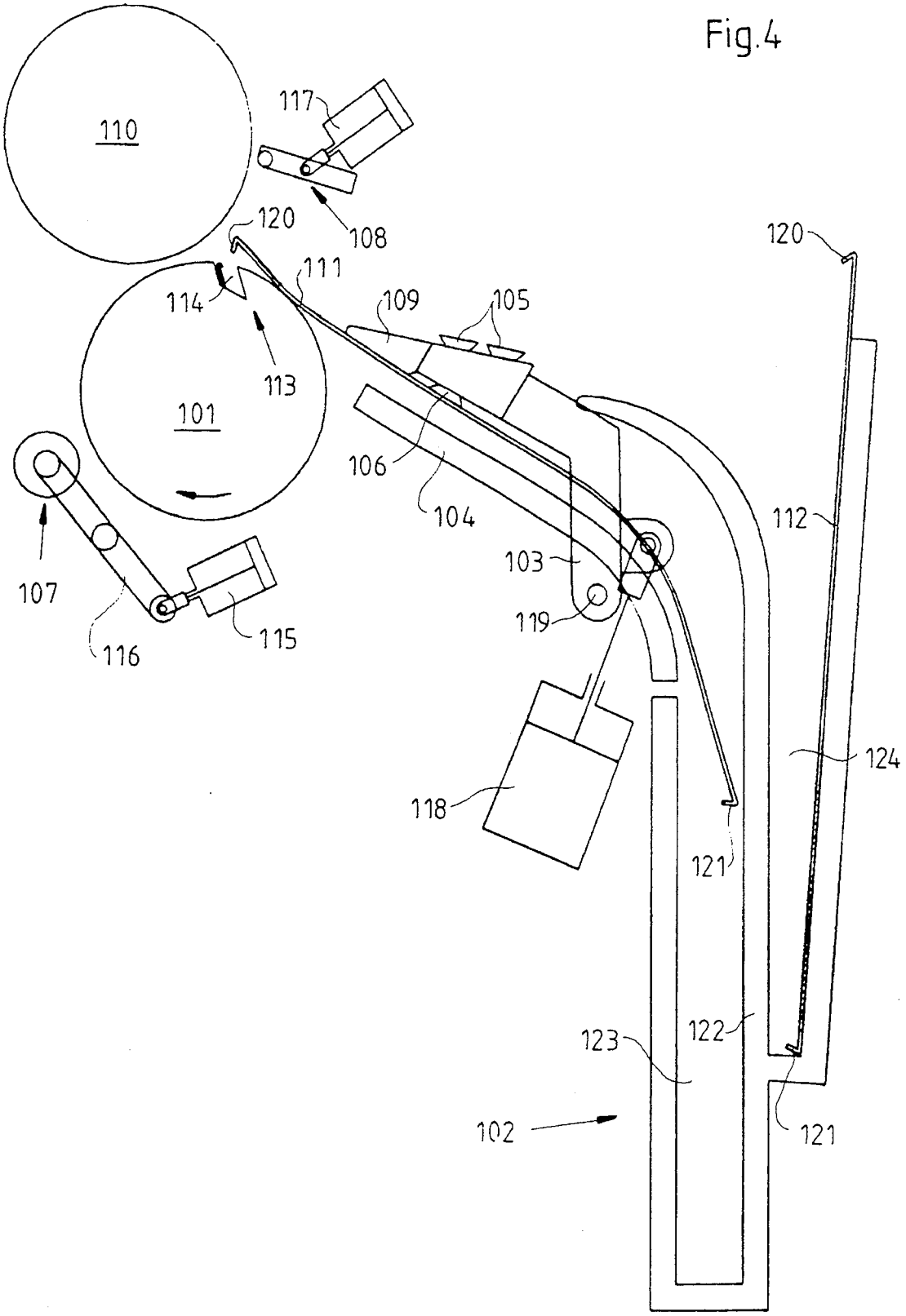
FIG. 4 is another view like that of FIGS. 1 to 3 in yet another operating phase of the device, wherein the removed or withdrawn printing form is transported into a front chamber of the magazine.

In the operating phase represented in FIG. 4, the first printing form or plate 111 has already penetrated to a considerable extent into the front chamber 123. The lower take-up element 106 is then activated so that it brakes the movement of the printing form or plate 111 removed from the cylinder 101. With the first plate 111 having then been immobilized by the take-up element 106, the holding device 113 also releases the leading edge 120 of the printing form or plate 111. Due to the elasticity thereof, its leading edge 120 then swings out of the gap or channel 114; the first printing form or plate 111 is then held only by the lower take-up element 106.

The cylinder 101 continues to rotate in reverse direction and, as a result of the first printing form or plate 111 being positioned at the surface thereof and the rolling contact effected thereby, the printing form or plate 111 is shoved farther into the front chamber 123. The holding element 106 then releases this first printing form or plate 111, and the holding element 103 swivels upwardly, as viewed in FIG. 4, to come to bear against the second printing form or plate 112 which is then to be applied to the cylinder 101. The released first printing form or plate 111 then travels farther due to the force of gravity into the front chamber 123 of the magazine 102.

The rotation of the cylinder 101 is stopped, and the upper holding elements 105 become affixed to the second printing form or plate 112 located in the rear chamber 124 of the magazine 102, the chamber 124 being at a slightly higher elevation than that of the other chamber 123. Because this second printing form or plate 112 must be bowed or curved in order to be transported on the surface of the printing-form or plate cylinder 101, two holding elements 105 are provided on the swivelable holding element 103. The thus affixed printing form or plate 112 is then positioned at the surface of the printing-form or plate cylinder 101 by swiveling the holding element 103.

Figure 5:
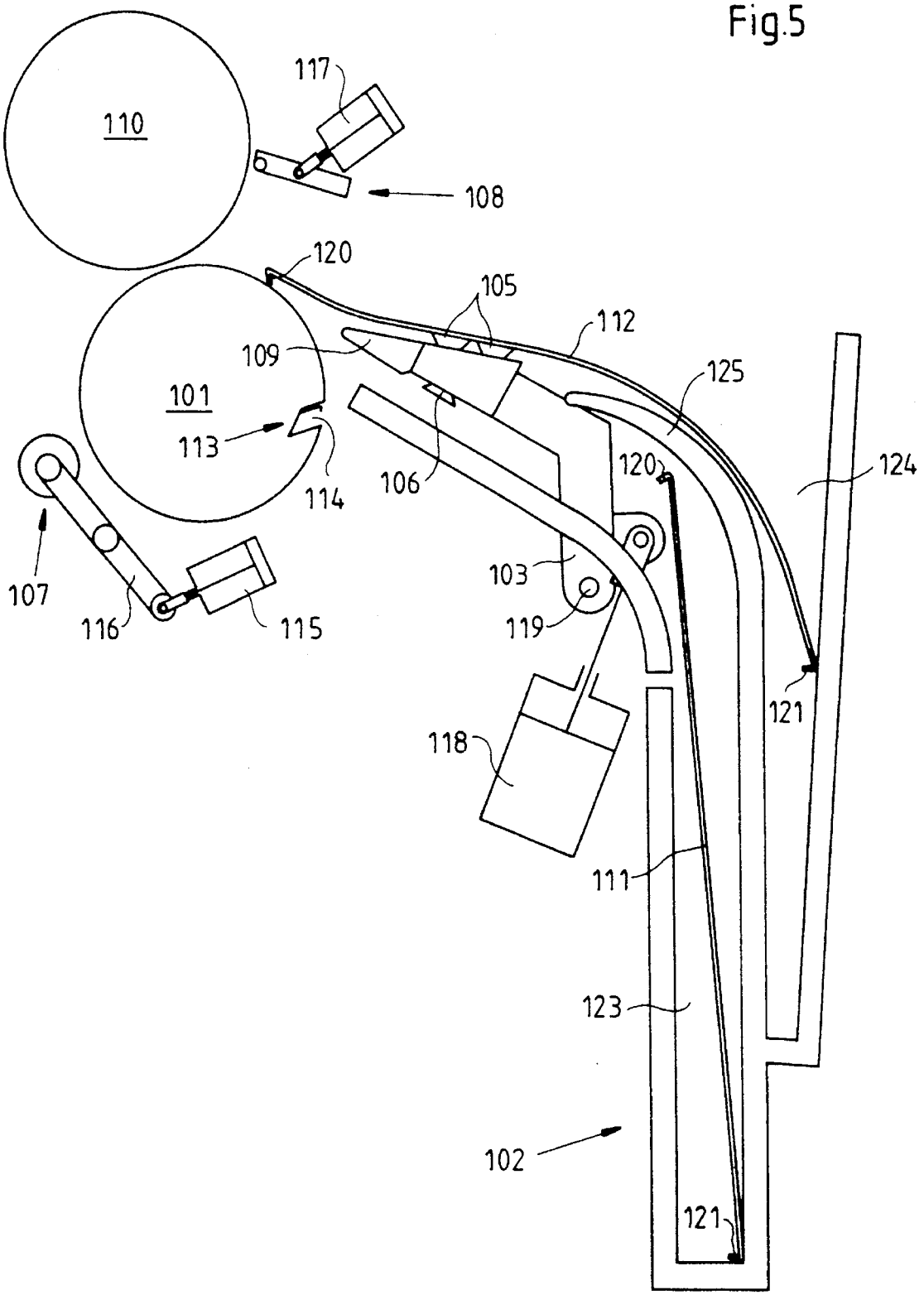
FIG. 5 is a view like that of FIGS. 1 to 4 in yet a further operating phase of the device, wherein the second printing form or plate is gripped by the swivelable holding element and is being fed onto the printing-form or plate cylinder.

As shown in FIG. 5, the leading edge 120 of the printing form or plate 112 is positioned at the surface of the printing-form or plate cylinder 101 by the swiveling of the holding element 103. The pressure element 107 is disengaged or separated from the printing-form or plate cylinder 101, and the latter rotates slowly in the forward direction, i.e, counterclockwise in FIG. 5. When the gap or channel 114 passes by, the leading edge 120 of the second printing form or plate 112 is resiliently introduced into the holding or fastening device 113, due to which the second printing form or plate 112 is drawn slowly onto and around the circumference of the cylinder 101. While the second printing form or plate 112 is being wound around the cylinder 101, the upper take-up elements 105 remain activated. The take-up elements 105 may be formed as suction cups, for example, in which case, the vacuum or negative pressure to which they are subjected is maintained until most of the second printing form or plate 112 has been disposed around the printing-form or plate cylinder 101.

Figure 6:
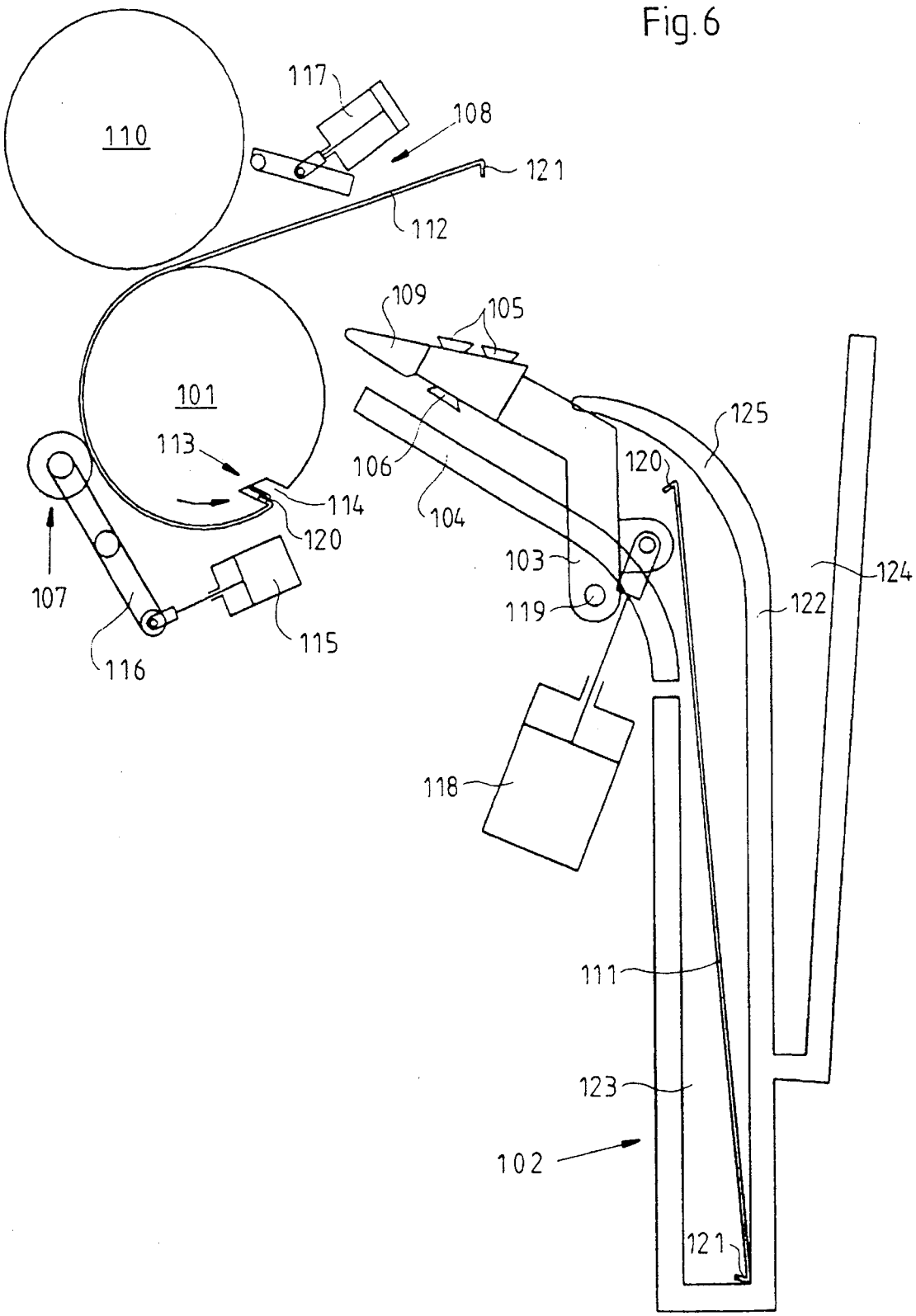
FIG. 6 is another view like that of FIGS. 1 to 5 in yet an additional operating phase of the device, wherein the second printing form or plate is now disposed around the circumference of the printing-form or plate cylinder.

When the trailing edge 121 of the second printing form or plate 112 has approached close to the upper holding elements 105, as represented in FIG. 6, the pressure element 107, which is formed as a roller mounted on a lever 116 in the illustrated embodiment of the invention, is positioned at the printing form or plate 112 which is to be newly mounted on the cylinder 101. This printing form or plate 112 is then released from the upper holding elements 105, due to which the trailing end of the printing form or plate 112 springs resiliently upwards and away from the swivelable holding element 103. The printing-form or plate cylinder 101 then completes one revolution.

Figure 7:
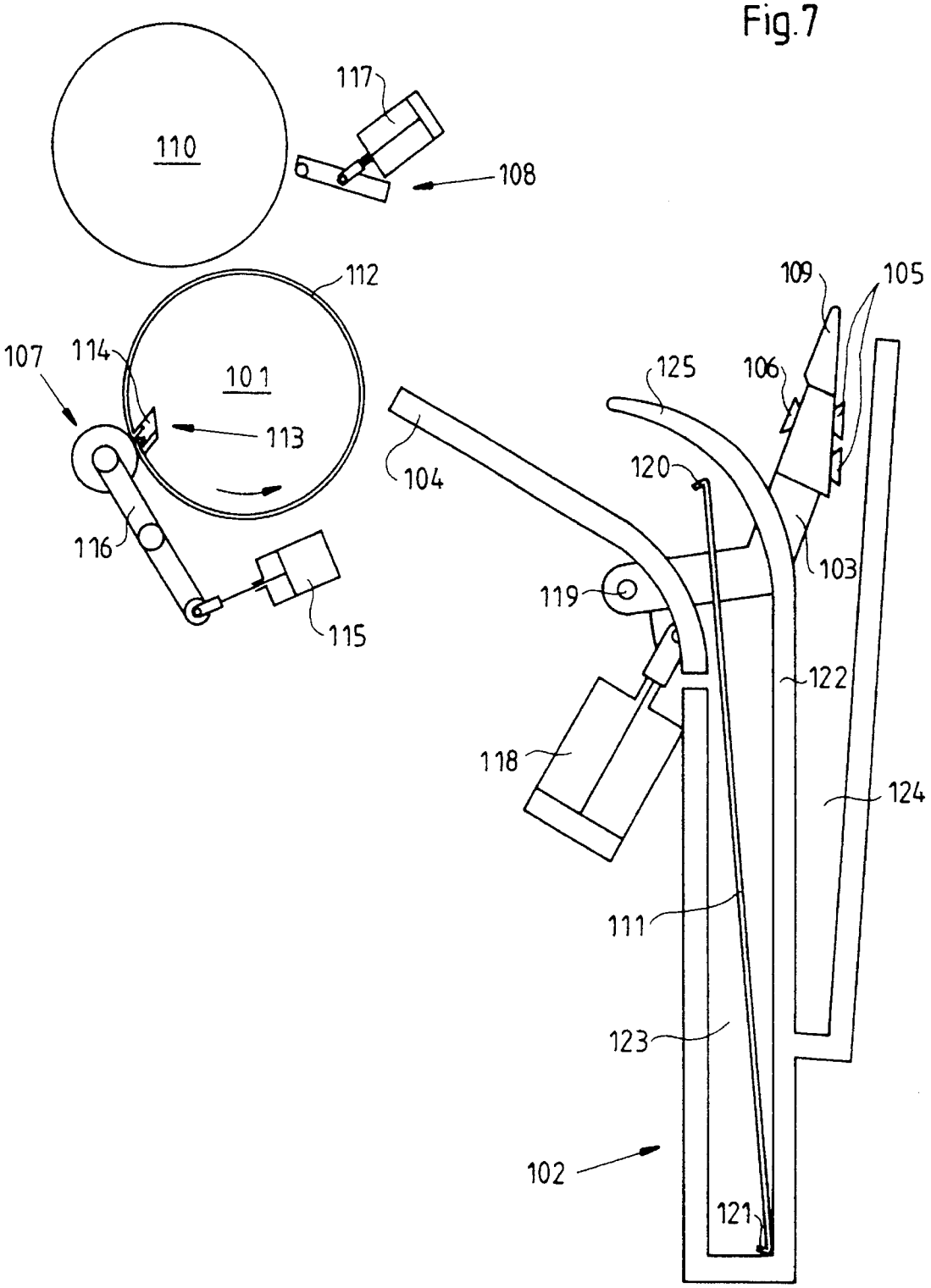
FIG. 7 is a final view like that of FIGS. 1 to 6 in another operating phase of the device, wherein the second printing form or plate which has been fed onto the surface of the printing-form or plate cylinder is pressed into a holding or fastening device thereon.

In the view of FIG. 7, the gap or channel 114 lies together with the holding or fastening device 113 opposite the pressure element 107. The latter pushes the trailing edge 121 of the newly applied printing form or plate 112 into the holding or fastening device 113, wherein then both the leading edge 120 and the trailing edge 121 of the second printing form or plate 112 are then fixed or fastened. During the mounting of the second printing form or plate 112 on the cylinder 101, the pressure element 107 aids in closely fitting the printing form or plate 112 on the surface of the cylinder 101. The second printing form or plate 112 is thus, so to speak, pressed on before the trailing edge 121 thereof is clamped by the holding or fastening device 113.

The swivelable holding element 103 swivels back so that the extension 109 returns to the substantially vertical position thereof, and the removed printing form or plate 111 can then be taken from the magazine 102. The protection device 108 is then also swung back into the nip between the transfer cylinder 110 and the printing-form or plate cylinder 101.

I claim:

1. Device for changing printing forms on a printing-press form cylinder having a gap formed therein containing a holding device associated with a printing start, the holding device having a gripping region openable so as to form a gap extending over a printing-form format width for taking-up a leading edge of a printing form therein, comprising a swivelable holding element for selectively removing a first printing form from the form cylinder and applying a second printing form onto the form cylinder.

2. Printing-form changing device according to claim 1, wherein said swivelable holding element includes an extension extensible to at least proximate to the surface of the form cylinder.

3. Printing-form changing device according to claim 1, including a swivel pin about which said holding element is swivelable.

4. Printing-form changing device according to claim 1, wherein said holding element has at least two sides, and including take-up elements disposed on said two sides of said holding element.

5. Printing-form changing device according to claim 4, wherein said take-up elements are formed as suction cups subjectible to negative pressure.

6. Printing-form changing device according to claim 1, including a magazine operatively associated with said swivelable holding element.

7. Printing-form changing device according to claim 6, wherein said magazine is subdivided into a plurality of chambers.

8. Printing-form changing device according to claim 6, wherein said magazine is formed with lateral openings.

9. Printing-form changing device according to claim 6, wherein said magazine is formed with a front chamber and a rear chamber relative to the form cylinder.

10. Printing-form changing device according to claim 7, wherein said magazine is formed with a subdividing partition between said chambers.

11. Printing-form changing device according to claim 10, wherein said partition is formed with a curved region.

12. Printing-form changing device according to claim 9, wherein said front and rear chambers are formed with respective bottom surfaces, said bottom surface of said rear chamber being located at a higher elevation than that of said bottom surface of said front chamber.

13. Printing-form changing device according to claim 2, including a magazine for printing forms, said magazine being formed with a guide, and wherein said extension of said swivelable holding element in a position thereof close to the form cylinder is disposed above said guide of said magazine.

14. Printing-form changing device according to claim 2, wherein said extension of said swivelable holding element serves as a stop for the first printing form to be removed from the form cylinder.

15. Printing-form changing device according to claim 1, wherein said swivelable holding element is swivelable with the second printing form which is being applied to the form cylinder so that an edge of the second printing form is placed against the surface of the form cylinder.

* * * * *